United States Patent [19]

Helfrich

[11] Patent Number: 4,807,930

[45] Date of Patent: Feb. 28, 1989

[54] SEATING APPARATUS PLANAR FOLD SLING

[76] Inventor: Bob Helfrich, 1411 Merced St., Richmond, Calif. 94804

[21] Appl. No.: 60,625

[22] Filed: Jun. 11, 1987

[51] Int. Cl.[4] ..... A47C 4/28

[52] U.S. Cl. ..... 297/219; 297/45; 297/229; 297/457

[58] Field of Search ..... 297/16, 45, 46, 55, 297/56, 219, 228, 229, 441, 457

[56] References Cited

U.S. PATENT DOCUMENTS

| | | | |
|---|---|---|---|
| 1,942,112 | 1/1934 | McQuilken | 297/45 |
| 2,689,602 | 9/1954 | Morgan | 297/441 X |
| 4,583,778 | 4/1986 | Liebhold | 297/441 X |

FOREIGN PATENT DOCUMENTS

| | | | |
|---|---|---|---|
| 220998 | 5/1987 | European Pat. Off. | 297/457 |
| 2506661 | 9/1975 | Fed. Rep. of Germany | 297/45 |

*Primary Examiner*—Kenneth J. Dorner
*Assistant Examiner*—Peter R. Brown

[57] ABSTRACT

An improved sling seat for a folding chair of the type having a frame constructed of a plurality of pivotally connected strut members supporting a sling seat. The sling seat improvement including a plurality of fold lines which radiate outwardly from a common point on the centerline of the sling. The fold lines permitting a thick semi-inflexible fabric sling seat of this pattern to fold, in a non-crumpled wrinkle-free form, with the frame, thereby allowing the frame to fold more compactly than previously with such fabric slings and allowing this sling seat to remain upon the folded frame for simple storage or transport.

1 Claim, 2 Drawing Sheets

FIG. 15
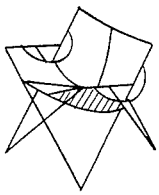
FIG.16
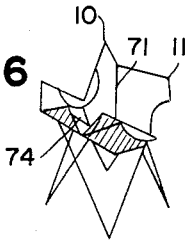
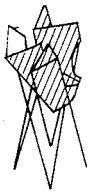
FIG. 17
FIG.18
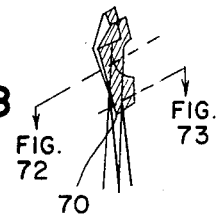
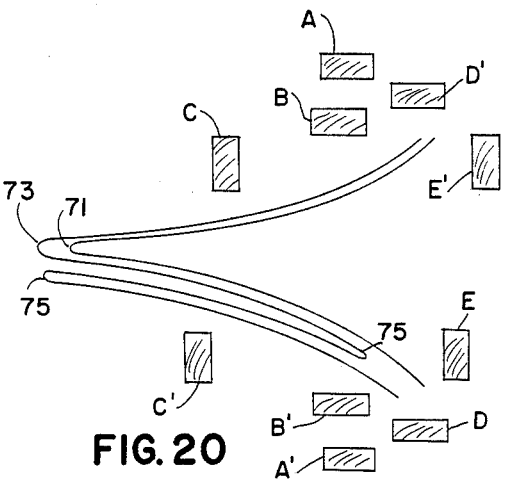
FIG. 20
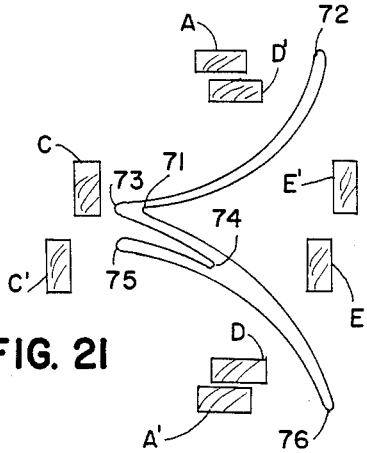
FIG. 21
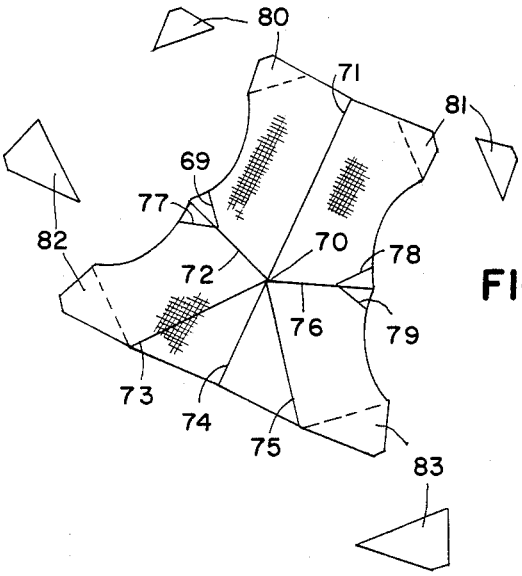
FIG. 19

SEATING APPARATUS PLANAR FOLD SLING

BRIEF SUMMARY OF INVENTIONS

The inventions herein comprise designs radiating from a first principal invention in folding chair design. This principal invention generally relates to folding chairs of the type having a frame, constructed of a plurality of pivotally connected strut members, supporting a fabric sling seat. This principal invention particularly relates to the manner in which the side members of such a chair frame are positioned with relationship to one another on a nominally vertical plane. Arm chairs and straddle chairs may be constructed utilizing this principle invention.

Other inventions radiating from this principal invention include the following.

An improved folding sling seat is effected for use on the arm chair. The improvement allowing a semi inflexible material seat to fold compactly upon the folder chair frame.

DESCRIPTION OF DRAWINGS

FIG. 15- Planar fold sling, on unfolded arm frame, diagram view.

FIG. 16- Planar fold sling, $\frac{1}{3}$ folded, diagram view.

FIG. 17- Planar fold sling, $\frac{2}{3}$ folded, diagram view.

FIG. 18- Planar fold sling, folded on arm frame, diagram view.

FIG. 19- Planar fold sling pattern, plan view.

FIG. 20- Planar fold sling, folded on frame A, sectional view from FIG. 18.

FIG. 21- Planar fold sling, folded on frame A, sectional view from FIG. 18.

*Dotted line represents pockets on sling back for supporting frame.

FOLDING ARM CHAIR

Figure 1:
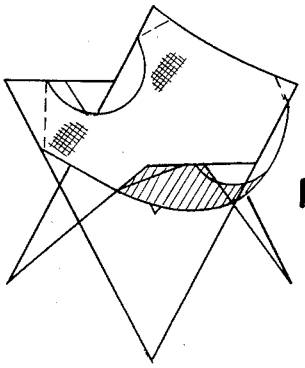
FIG. 1- Arm chair, 10 member frame, diagram view.*
Figure 4:
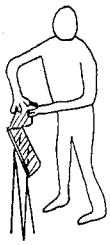
FIG. 4- Finish of folding arm chair, diagram view.

The folding arm chair comprises a folding frame which effects arms, and a sling seat (FIG. 1). The chair folds compactly into an alongated form (FIG. 4).

Using the Arm Chair

Figure 2:
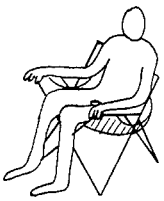
FIG. 2- Arm chair seating position, diagram view.
Figure 3:
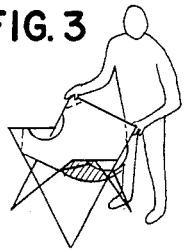
FIG. 3- Start of folding arm chair, diagram view.*

Seating position in this chair is with feet on the floor with arms on arm rests (FIG. 2). The chair is folded from behind, grasping the two outward upper points of the back (FIG. 3) and pushing them together (FIG. 4.) The chair is opened in the reverse order.

Making the Arm Chair

Figure 5:
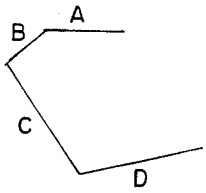
FIG. 5- Arm frame, first sub assembly, diagram plan view.

1- Pivotally connect four members A,B,C and D to form a frame sub assembly (FIG. 5).

Figure 6:
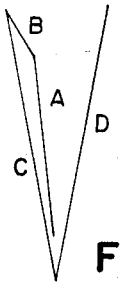
FIG. 6- Folded arm frame, first sub assembly, diagram view.

2- Such that this frame sub assembly can fold with all members being relatively parallel (FIG. 6).

Figure 7:
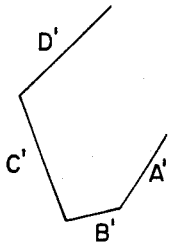
FIG. 7- Arm frame, second sub assembly, diagram plan view.

3- Pivotally connect four members A',B',C' and D' to form a second frame sub-assembly, this sub assembly being composed of like members and mirror image assembly to the first sub assembly (FIG. 7).

Figure 8:
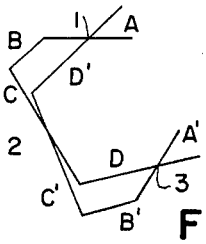
FIG. 8- Arm frame assembly, 8 member, diagram plan view.

4- Interlace the two frame sub assemblies such that they cross and pivotally connect at three points intermediate the ends of the connecting members (FIG. 8; 1,2,3).

Figure 9:
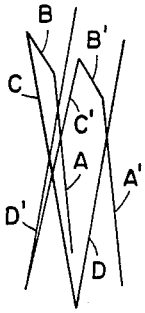
FIG. 9- Folded arm frame, 8 member, diagram view.

5- Such that this eight member frame assembly can fold and wherein all members are relatively parallel (FIG. 9).

Figure 10:
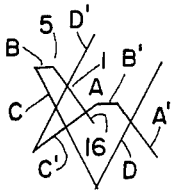
FIG. 10- Arm frame, 8 member, diagram view.

6- Such that when unfolded to the form desired to effect a chair frame the the connection of members A and B (5) is above the connection of members A and D' (6), such as to produce a result of members B and B' being used as chair arms (FIG. 10).

Figure 11:
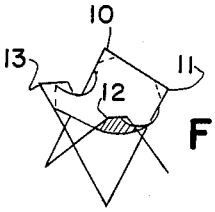
FIG. 11- Arm chair, 8 member frame, diagram view.*

7- A fabric sling slung from 10, 11, 12 and 13 provides a seat (FIG. 11).

Figure 12:
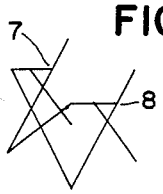
FIG. 12- Arm frame, 8 member, diagram view.

8- Additional chair frame stability and a means for stopping unfolding of the frame, in addition to that provided by the sling seat, can be achieved by extending members B and B' to crossings with D' and D respectively (FIG. 12;7,8).

Figure 13:
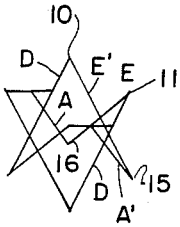
FIG. 13- Arm frame, 10 member, diagram view.

9- Additional chair frame stability can be achieved by adding a crossed pair of pivotally connected, equal length members E and E' to the unattached ends of members A,D,A' and D' respectively (FIG. 13; 10,11,15,16).

Figure 14:
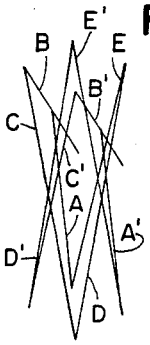
FIG. 14- Folded arm frame, 10 member, diagram view.

10- Such that this ten member frame can fold and wherein all members are relatively parallel (FIG. 14).

PLANAR FOLD SLING

As earlier described a fabric sling slung from pts 10,11,12 and 13 on the arm chair frame can effect a seat for these chairs, Such sling seats, if of a flexible quality, can fold with the chair frames, being therefore able to be retained upon the folded chair. This desireable quality is not possible with sling seats constructed of less flexible material, such as thick leather or carpeting. These less flexible slings crumple when attempting to fold them with the chair frames. The crumpling blocks the folding frame from total closure. A preferred form of this invention is a sling seat patterned such as to be able to reduce this undesireable crumpling, thereby allowing a chair with a less flexible sling seat to fold completely, with the sling seat being retained thereon. I call this a planar fold sling.

A planar fold sling seat is a fabric, or the like, seat of nominal conformation to an isosceles trapezoid, at the four corners of which, on the back sides, are sewn fabric pieces in the general shape of triangles, such as to form pockets to receive the supporting chair frame (FIG. 19; 80,81,82,83). Six fold lines radiate from a common point (70) along the longitudinal centerline of the sling. Two of these, ridge folds, extend along the said centerline away from the common point. The first (71) extends to the back of the sling. The second (74) extends to the front of the sling. Two more of these fold lines, valley folds (73,75), extend outwardly and forwardly symmetrically about the centerline, from said common point to points on the forward edge of the sling at the inward edge of the corner pockets 82 and 83. The last two fold lines, valley folds, extend outwardly and rearwardly symmetrically about said centerline, from said common point to the sides of the sling (72,76). Darts are sewn along these last fold lines for seating comfort, by sewing line 69 to line 77, and line 78 to line 79. Said common point is positioned along said centerline such as to satisfy two requirements. The first requirement being, that it lie approximately under the coccyx of the seated personin the unfolded chair, such as to provide seating comfort. The second requirement being, that it lie behind the front chair frame members, and ahead of the rear frame members in the folded chair, such as to permit complete folding of the chair frame (FIG. 18; 70).

The operation of this sling invention is illustrated in FIGS. 14 18. FIG. 5 illustrates the unfolded chair with the planar fold sling. As the two upper back points of the chair frame (FIG. 16; 10,11) are pushed together, the frame folds, including folding of the sling along the fold lines. The two ridge folds (71,74) move toward one another, and then bypass (FIG. 17). They continue to bypass increasingly to that point where the sling is folded as figuratively described by a letter V within a letter W (FIGS. 18,20,21).

The horizontal sections (FIG. 20 and FIG. 21) taken through the folded chair shown in FIG. 18 illustrate how the fold lines are positioned on the folded sling. At the elevation at which the first of these cross sections is cut (FIG. 20), the fold lines 71,73 and 75 project forwardly, extending between and beyond the front crossing members C and C'. At the lower elevation at which the second cross section is cut (FIG. 21), the fold lines 72 and 76 project rearwardly and laterally, extending between and beyond the frame members D' and E', and D and E, respectively.

Because a sling of this pattern extends beyond the space circumscribed by the chair frame cage, as previously described, the amount of sling within that folded frame interior space is reduced. The result is that the frame is able to more compactly fold, because of the reduced amount of sling retained within the folded frame to block closure.

Examination of the cross sections described above shows that the sling does not crumple when the frame folds. The fold lines prevent that occurance.

Therefore, use of a sling of this pattern, with thick and semi-inflexible fabric upon folding chairs of the type using a plurality of pivotally connected strut members, allows the folding chair to close compactly with retention of a non-crumpled wrinkle-free sling upon the frame for transport or storage.

I claim:

1. An improved folding chair of the type having, a chair frame composed of a plurality of pivotally connected members, and a sling seat supported at a plurality of points by the frame, said support points being symmetrically positioned about a centerline on the sling seat, said centerline extending longitudinally from a midpoint of the seat front edge to a midpoint of the backrest upper edge, wherein the improvement comprises:

a- a pair of ridge fold lines radiating in opposite directions along said centerline from a common point on the centerline, said common point being positioned between the upper edge of the seat backrest and the forward edge of the seat, b- a first pair of valley fold lines radiating symmetrically about said centerline from said common point toward opposite lateral edges of the seat.

c- a second pair of valley fold lines radiating symmetrically about said centerline from said common point to points on opposite sides of the centerline on the front edge of the seat, and d- a positional relationship of elements of the sling seat upon the folded chair having a cross-sectional form figuratively similar to a letter V nesting within a cusp of the letter W, and further having the vertex of the angle of the letter V being the ridge fold line of the backrest, and still further having the vertex of the angle between the cusps of the letter W being the ridge fold line of the seat portion of the sling.

* * * * *